US006819297B2

(12) United States Patent
DePardo

(10) Patent No.: US 6,819,297 B2
(45) Date of Patent: Nov. 16, 2004

(54) WIDEBAND PLANAR ANTENNA

(75) Inventor: Dan DePardo, Lawrence, KS (US)

(73) Assignee: University of Kansas, Lawrence, KS (US)

( * ) Notice: Subject to any disclaimer, the term of this patent is extended or adjusted under 35 U.S.C. 154(b) by 0 days.

(21) Appl. No.: 10/192,758

(22) Filed: Jul. 10, 2002

(65) Prior Publication Data

US 2004/0008152 A1 Jan. 15, 2004

(51) Int. Cl.[7] ..... H01Q 13/00
(52) U.S. Cl. ..... 343/772; 343/781; 343/786
(58) Field of Search ..... 343/772, 781, 343/786, 776, 840; 333/26, 33, 84, 24 R, 219, 222, 245, 260

(56) References Cited

U.S. PATENT DOCUMENTS 3,581,311 A * 5/1971 Kach ..... 343/781
4,002,943 A * 1/1977 Regan et al. ..... 315/39
4,819,005 A * 4/1989 Wilkes ..... 343/786

* cited by examiner

*Primary Examiner*—Hoang V. Nguyen
(74) *Attorney, Agent, or Firm*—Schwegman, Lundberg, Woessner & Kluth, P.A.

(57) ABSTRACT

An energy feed structure includes a first tube having an open end and a closed end, a second tube to pierce the closed end, and a solid dielectric material to cover the open end. An apparatus comprises a resonant element located in a first plane, a ground plane located in a second plane (typically spaced apart from and substantially parallel to the first plane), and an energy feed structure. A system comprises an apparatus, including a resonant element, a ground plane, and an energy feed structure, as well as a radio frequency connector having a center conductor electrically coupled to the feed structure. A method includes forming a ground plane, forming a planar resonant element, and forming an energy feed structure capable of passing through the ground plane and being capacitively coupled to the resonant element.

21 Claims, 5 Drawing Sheets

WIDEBAND PLANAR ANTENNA

TECHNICAL FIELD

Embodiments of the invention relate generally to antennas. More particularly, embodiments of the invention relate to wideband antennas, including planar receiving antennas.

BACKGROUND INFORMATION

The gradual degradation of television (TV) video and audio signal quality seen in analog television systems often appears as "ghosting" and other channel noise at the receiver. In a digital TV signal environment, multipath or low level signal conditions create bit errors that are initially seen as video artifacts, including blockiness and pixelization. There may also be audio artifacts. However, when the number of reception errors reaches a certain level, complete loss of the video image and accompanying audio can occur in a relatively abrupt manner.

One example of this situation arises when Digital TV/High Definition TV (DTV/HDTV) receivers have difficulty resolving multiple replicas of the same signal arriving at the receiver input (i.e., multipath signals). Replicated signals can effectively cancel out the data contained in the strongest direct path signal, which serves to increase the digital signal Bit Error Rate (BER) to the point where there are simply too many errors to display a coherent video image, or even to reproduce the audio portion of the signal. This effect, wherein a DTV broadcast is lost completely due to the existence of multipath or low level signals, has been labeled the "cliff effect".

TV receivers generally rely on antennas to provide some relief from such problems. However, many TV antennas do not operate well under multipath signal conditions. Antennas that are more effective in dealing with multipath signals often have a limited response bandwidth, and some are characterized by a large wind area, creating a "sail" which is easily damaged in moderate to high winds. For these and other reasons, antennas with the ability to reduce the negative effects of multipath signals, while offering a wider bandwidth and resistance to wind effects, are needed.

SUMMARY OF EMBODIMENTS OF THE INVENTION

Embodiments of the invention described herein may be used to provide a wideband, planar receiving antenna that performs well under multipath signal reception conditions. An enhanced method of coupling signal energy to the antenna is utilized, and some of the structural elements may include an open mesh which operates to reduce the wind effects presented by outdoor installations.

In one embodiment, an energy feed structure may include two tubes, the first having an open end and a closed end, and the second located so as to pierce the closed end of the first tube. The feed structure includes a solid dielectric material to cover the open end of the first tube. The centerlines of the tubes are generally located so as to be offset, but substantially parallel.

In another embodiment, an apparatus may include a resonant element, a ground plane, and the energy feed structure (capacitively coupled to the resonant element), as described. Either, or both the resonant element and the ground plane may comprise a solid sheet of material, or an open mesh to reduce the wind effects of outdoor installations. The resonant element and the ground plane are typically separated using one or more non-conductive standoff elements.

In another embodiment, a system may include the apparatus described, as well as a radio frequency connector, wherein the feed structure is electrically coupled to the radio frequency connector. A support can be electrically coupled to the ground plane, and a cable may be electrically coupled to the radio frequency connector.

Thus, in yet another embodiment, a method of fabricating an apparatus and a system according to various embodiments of the invention may include forming a ground plane, forming a planar resonant element, and then forming an energy feed structure having a solid dielectric element.

DETAILED DESCRIPTION OF EMBODIMENTS OF THE INVENTION

Figure 1:
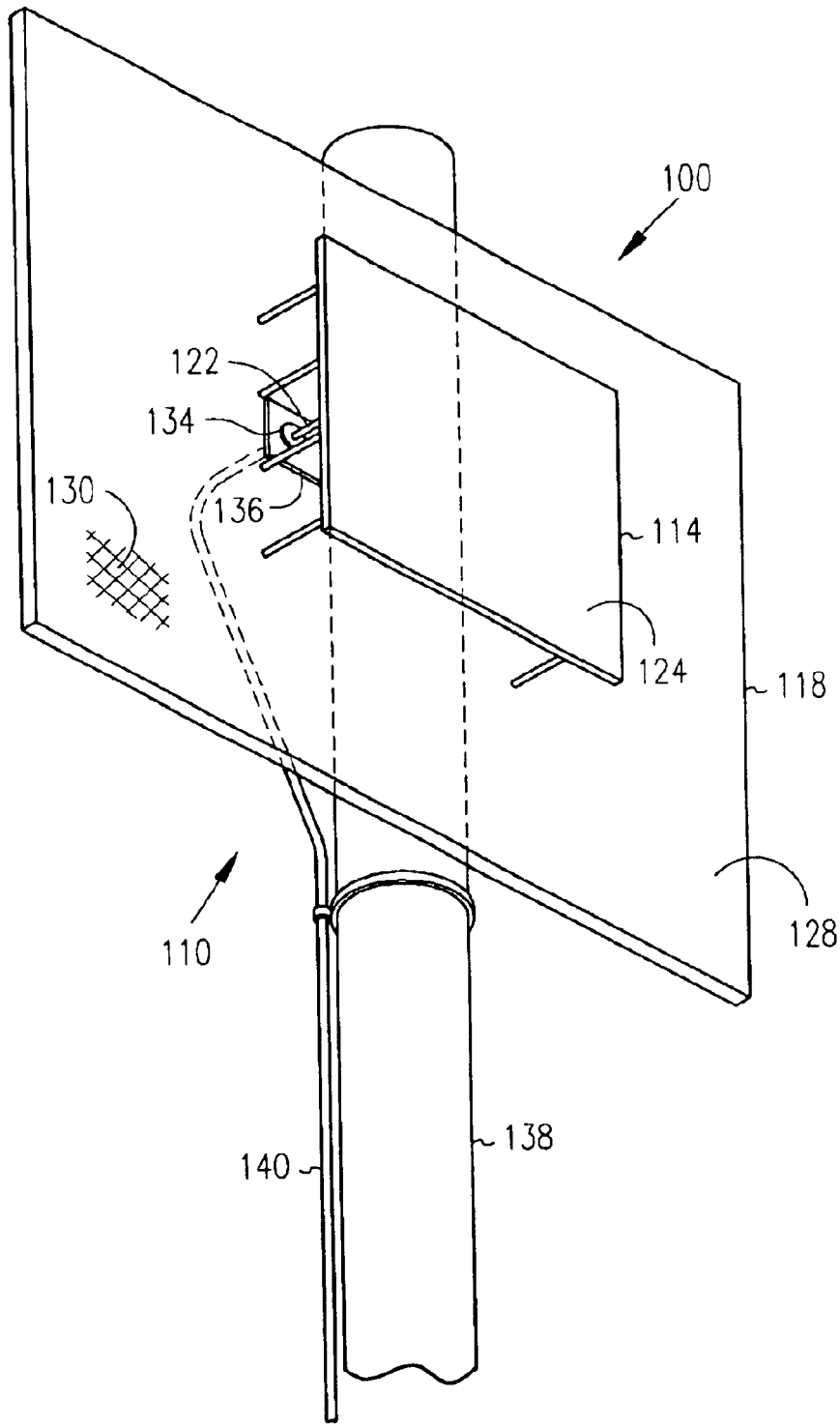
FIG. 1 is a perspective view of an apparatus and system constructed according to various embodiments of the invention.

In the following detailed description of embodiments of the invention, reference is made to the accompanying drawings that form a part hereof, and in which are shown by way of illustration, and not of limitation, specific embodiments in which the invention may be practiced. In the drawings, like numerals describe substantially similar components throughout the several views. The embodiments illustrated are described in sufficient detail to enable those skilled in the art to understand and implement them. Other embodiments may be utilized and derived therefrom, such that structural and logical substitutions and changes may be made without departing from the scope of the present disclosure. The following detailed description, therefore, is not to be taken in a limiting sense, and the scope of various embodiments of the invention is defined only by the appended claims, along with the full range of equivalents to which such claims are entitled.

FIG. 1 is a perspective view of an apparatus and system constructed according to various embodiments of the invention. The apparatus 100 and system 110 according to an embodiment of the invention may include a resonant element 114, a ground plane 118, and an energy feed structure 122. Typically, the resonant element 114 is located in a first plane 124, and the ground plane 118 is located in a second plane 128 spaced apart from, and substantially parallel to, the first plane 124. The resonant element 114 may comprise a solid, rectangular sheet of metal, as may the ground plane 118. Alternatively, the resonant element or the ground plane 118 may comprise a rectangular sheet of metal including an open mesh 130, as shown in FIG. 1.

A system 110 according to an embodiment of the invention may include the apparatus 100, electrically coupled to a connector 134, such as a Radio Frequency (RF) connector, which may be similar to or identical to a type "N" or #82–97 connector made by Amphenol, Inc. To provide mechanical support for the RF connector 134, a plate 136, such as a 7 cm×7 cm×1.5 mm thick brass sheet may be used to mount the RF connector 134 to the ground plane 118.

The system 110 may also include a support pole 138, as well as a cable 140. The support pole 138 is typically electrically and mechanically coupled to the ground plane 118, and may serve as a conductive medium between the ground plane 118 and earth ground. The pole 138 may be made of steel, thick-walled aluminum tubing, and other materials of suitable structural strength. The cable 140 may be electrically coupled to the RF connector 134, as well as to a receiver, transmitter, and/or transceiver (not shown).

Figure 2A:
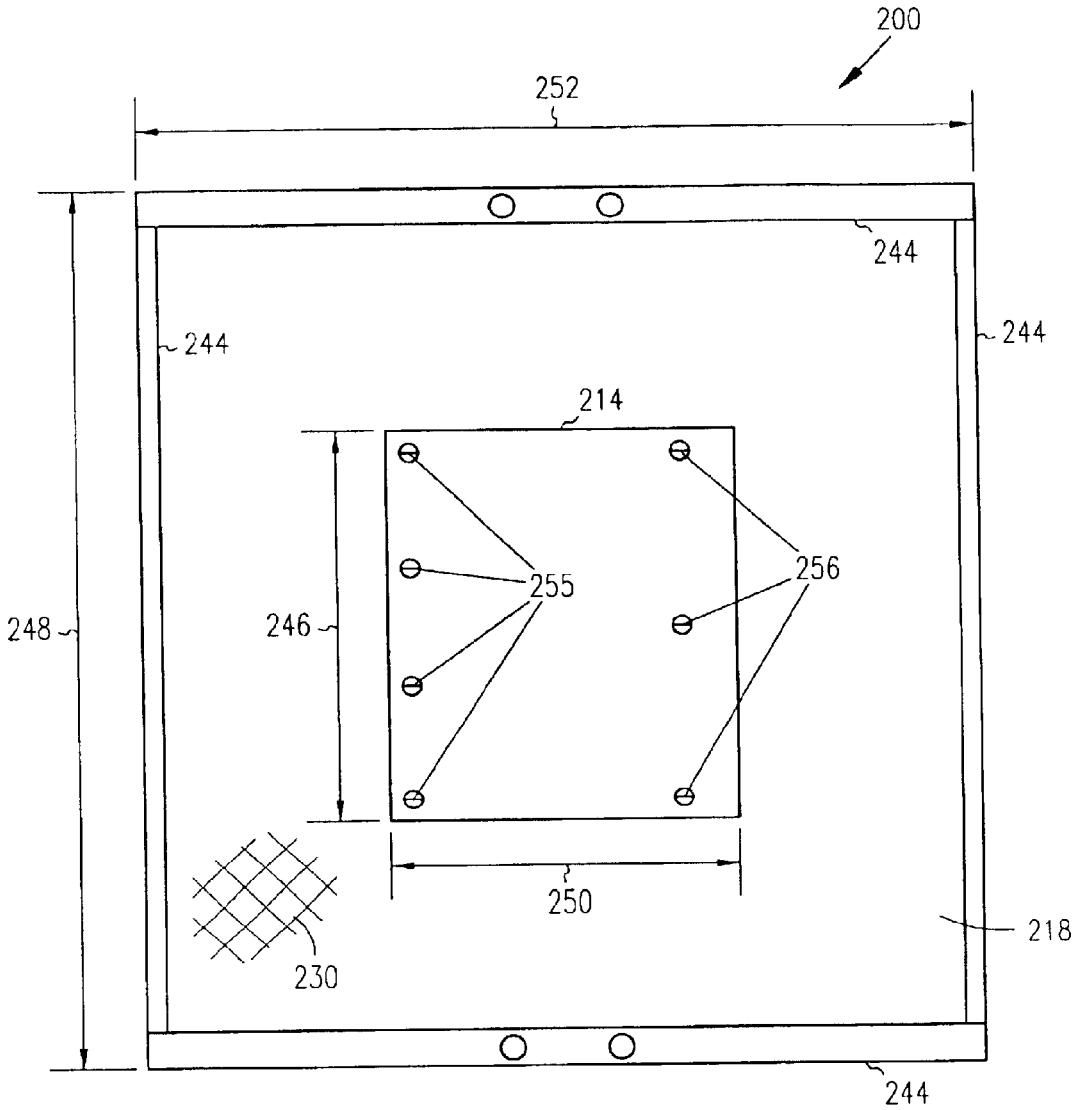
FIGS. 2A and 2B are front and top plan views, respectively, of an apparatus and system constructed according to various embodiments of the invention.
Figure 2B:
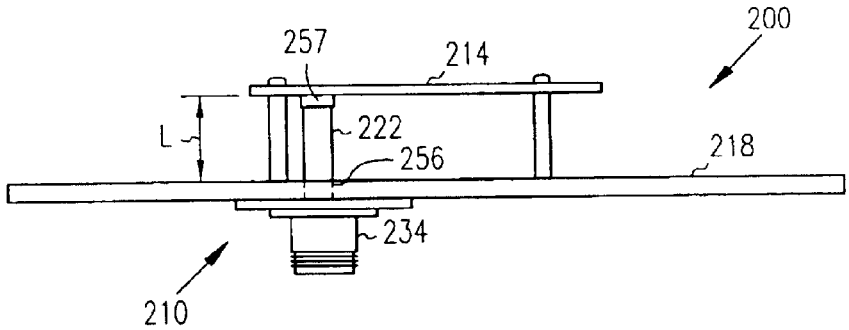

To gather additional details about some of the possible configurations for various embodiments of the invention, reference may now be made to FIGS. 2A and 2B, which are front and top plan views, respectively, of an apparatus and system constructed according to various embodiments of the invention. In this case, it is readily apparent that the resonant element 214 may comprise a solid rectangular sheet of electrically conductive material, including, but not limited to a sheet of metal, such as gold, silver, titanium, copper, aluminum, steel, brass, and/or a combination of alloys. If constructed in this manner, for example, the resonant element 214 may be a sheet of aluminum approximately 1.5 mm thick.

Alternatively, the resonant element 214 may also comprise a non-conductive supporting layer, having two sides, such as a fiberglass sheet, overlaid with a conductive resonant layer placed on one side or the other. The resonant element 214 may also comprise a rectangular sheet of one or more materials, of which at least one includes an open mesh.

The ground plane 218 may also comprise a solid rectangular sheet of electrically conductive material, including, but not limited to a sheet of metal, such as gold, silver, titanium, copper, aluminum, steel, brass, and/or a combination of alloys. Alternatively, the ground plane 218 may also comprise a non-conductive supporting layer, having two sides, such as a fiberglass sheet, overlaid with a conductive ground layer placed on one side or the other. The ground plane 218 may also comprise a rectangular sheet of material including, but not limited to an open mesh 230, such as an expanded aluminum mesh material, about 1.5 mm thick, including a plurality of square, rectangular, circular, or diamond-shaped apertures measuring approximately 8 mm×22 mm in size. Flat metal stock 244, such as flat brass stock may be attached to the border of the ground plane 218 to add rigidity to the apparatus 200 and the system 210.

If either or both the resonant element 214 and the ground plane 218 are formed from a non-conductive supporting layer, conductive material may be deposited onto, laid onto, or attached to the corresponding supporting layers to form the resonant element and the ground plane. Plating, vapor deposition, sputtering, as well as other techniques may be used to apply the conductive material to the corresponding non-conductive supporting layer.

As shown in the figures, the resonant element 214, as well as the ground plane 218, are typically formed as rectangles having a longer dimension 246, 248, respectively, and a shorter dimension 250, 252, respectively. The length of the longer dimension 246, 248 is typically related to the length of the corresponding shorter dimension 250, 252 by a ratio of about 5:4. However, the conductive surface area of the resonant element 214 is usually substantially smaller than the conductive surface area of the ground plane 218. For example, if the longer dimension 246 of the resonant element is about 24 cm, the corresponding shorter dimension of the resonant element 250 may be about 20 cm. In that case, the longer dimension of the ground plane 248 might be about 50 cm, with the corresponding shorter dimension 252 of the ground plane being about 46 cm.

To locate the resonant element 214 and the ground plane 218 in proper spatial relationship to each other, the apparatus 200 and system 210 may also include one or more standoff elements 255 inserted between the resonant element 214 and the ground plane 218. The standoff element(s) 255, typically made of a non-conductive material, including but not limited to such materials as nylon or some other plastic, will usually have a direct mechanical connection to the resonant element 214 and the ground plane 218. Thus, the length L of the standoff element(s) 255 will usually be substantially equal to the spaced apart distance between the resonant element 214 and the ground plane 218, which may be about one-tenth the length of the ground plane longer dimension 248, or about one-fifth the resonant element longer dimension 246. For example, if the dimensions 246, 250 of the resonant element are about 24 cm×20 cm, and the dimensions 248, 252 of the ground plane are about 50 cm×46 cm, the resonant element 214 may be separated from the ground plane 218 by a distance L of about 5 centimeters, perhaps using individual, tubular nylon standoff elements 255. Typically, the energy feed structure 222 passes through an aperture 256 in the ground plane 218 (without contacting the ground plane 218) so that solid dielectric material 257 included in the energy feed structure 222 can be located adjacent the resonant element 214.

Figure 3A:
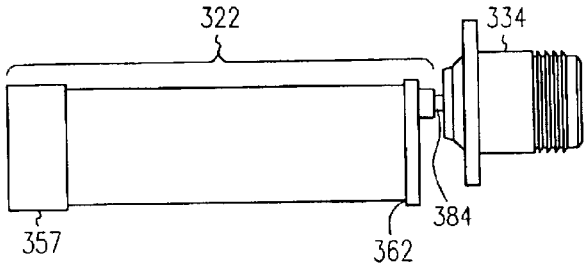
FIGS. 3A and 3B are assembled and exploded side views, respectively, of an energy feed structure constructed according to an embodiment of the invention.
Figure 3B:
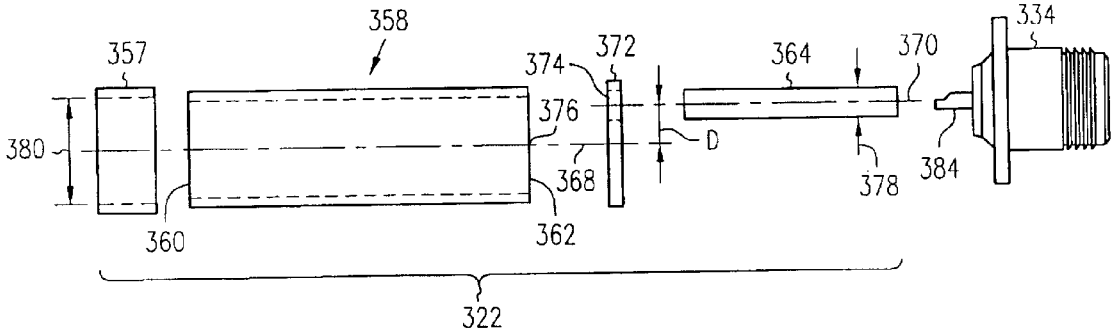

FIGS. 3A and 3B are assembled and exploded side views, respectively, of an energy feed structure constructed according to an embodiment of the invention. The energy feed structure 322 may include a first tube 358 having an open end 360 and a closed end 362, a second tube 364 to pierce the closed end 362, and a solid dielectric material 357 to cover the open end 360 of the first tube 358. The tubes 358, 364 may be located so as to be substantially parallel with respect to their centerlines 368, 370, respectively. Thus the second tube 364 may have a centerline 370 parallel to and offset some selected and substantially constant distance D from the centerline 368 of the first tube 358.

The closed end 362 of the first tube 358 may include a circular cap 372, preferably made of metal, and with or without a lip (no lip shown). The cap 372 may be soldered to the first tube 358. The second tube 364 may pierce or pass through the closed end 362 of the first tube 358 by way of an aperture 374 in the cap 372, typically offset from the center 376 of the closed end 362. Thus, in many embodiments, it is preferred to have the outer diameter 378 of the second tube 364 substantially equal to the diameter of the aperture 374, and smaller than the inner diameter 380 of the first tube 358. For example, if the first tube 358 is approximately 48 mm long, and about 15.7 millimeters in inside diameter 380, then the second tube 364 may be about 30 mm long, with an outside diameter 378 of about 3.9 mm, and an inside diameter of about 3.25 mm. Thus, the aperture 374 in the approximately 16.5 mm diameter cap 372 will be about 3.9 mm in diameter to accommodate the outside diameter 378 of the second tube.

The first tube 358 may be electrically coupled to the second tube 364 using solder or some other conductive medium that contacts both the first and second tubes. The tubes 358, 364 may also be capacitively coupled, using one or more dielectric media, including air. Either one of the tubes 358, 364, or both of the tubes 358, 364 may be made of a metal, such as gold, silver, titanium, copper, aluminum, steel, brass, and/or a combination of alloys.

As mentioned previously, the energy feed structure 322 also includes a solid dielectric material 357, such as a polyurethane. For example, the solid dielectric material 357 may include two layers of commonly available electric tape, such as the Scotch® Super 33+ tape available from 3M, each layer being approximately 7 mils thick. The energy feed structure 322 is typically capacitively coupled to the resonant element using a combination comprising air and the solid dielectric material 357. The solid dielectric material 357 is typically located so as to contact the resonant element on one of its sides, at a point located along the selected side at about one-half of the longer dimension and about one-fifth of the shorter dimension. Thus, for example, if the resonant element measures about 24 cm×20 cm, the solid dielectric material 357 will be located so as to contact the resonant element at about 12 cm along the longer dimension of one side, and at about 4 cm along the shorter dimension of the same side. The apparatus may be configured as an antenna having a characteristic impedance of 50 or 75 ohms, for example, depending on where the solid dielectric material 357 makes contact with the resonant element. When configured as a receiving antenna (shown in FIG. 1), the apparatus 100 exhibits linear polarization.

Thus, turning now to FIGS. 1, 2A, 2B, 3A, and 3C, it can be easily understood that a system 110, 210 according to an embodiment of the invention may comprise an apparatus 100, 200, as described previously, including a resonant element 114, 214, a ground plane 118, 218, and an energy feed structure 122, 222, 322, coupled to a radio frequency connector 134, 234, 334. In FIG. 3B it is readily apparent that the RF connector 334 may include a center conductor 384 electrically coupled to the feed structure 322.

Figure 4:
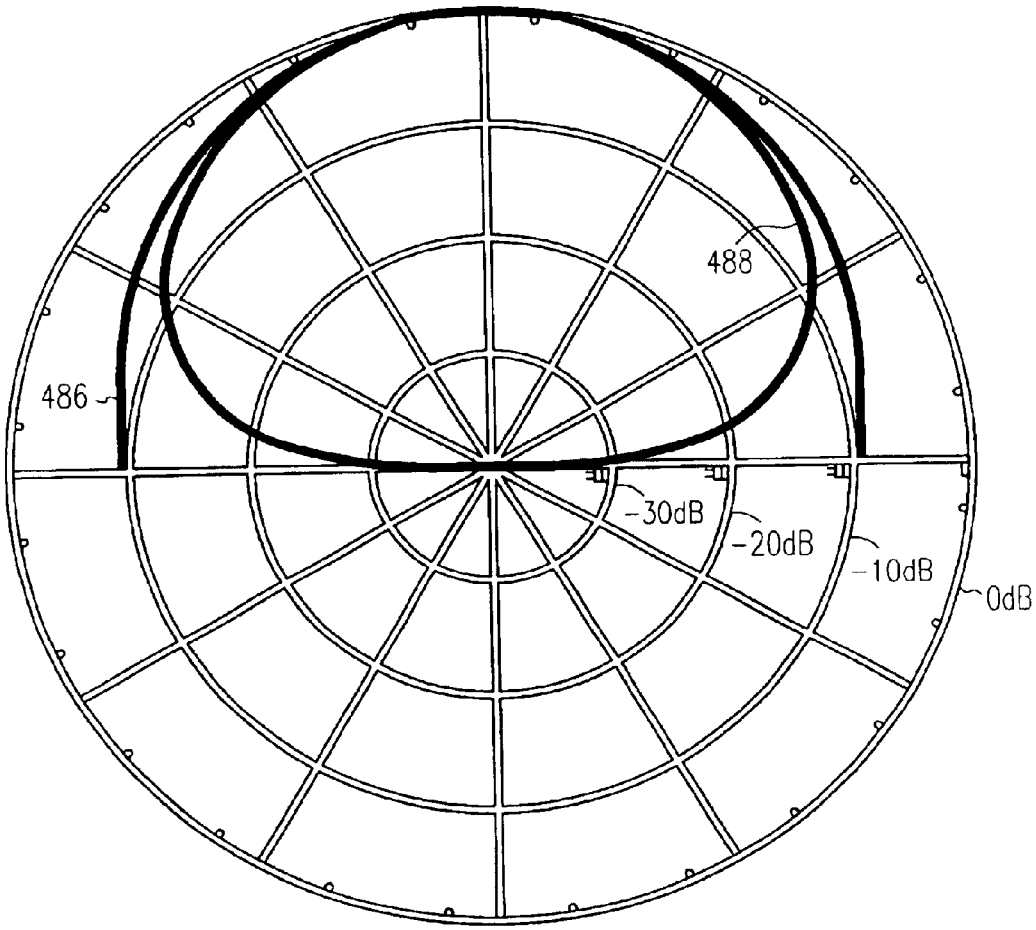
FIG. 4 is a theoretical planar plot of E and H field behavior for an apparatus constructed according to an embodiment of the invention.

FIG. 4 is a theoretical planar plot of E and H field behavior for an apparatus constructed according to an embodiment of the invention. In this case, an apparatus constructed in the form of a receiving antenna was designed to have a theoretical center frequency of about 585 MHz. As seen in FIG. 4, the theoretical E-plane beamwidth 486 was determined to be about 79 degrees. The theoretical H-plane beamwidth 488 was determined to be about 73 degrees. Reception to the rear of an antenna constructed according to various embodiments of the invention is thus greatly attenuated.

Figure 5:
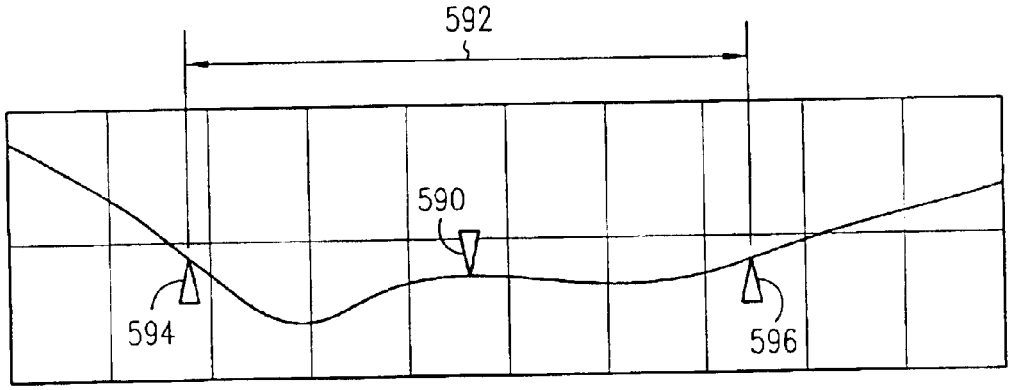
FIG. 5 is a measured plot of gain and bandwidth for an apparatus constructed according to an embodiment of the invention.

FIG. 5 is a measured plot of gain and bandwidth for an apparatus constructed according to an embodiment of the invention. The theoretical center frequency, as noted for FIG. 4, was about 585 MHz, with a theoretical gain of about 8.4 dBi, and a theoretical bandwidth of about 46%, or about 270 MHz. As can be seen in FIG. 5, the measured center frequency 590 was about 585 MHz, and the measured impedance-matched bandwidth 592 was about 230 MHz (from a lower frequency 594 of about 470 MHz, to an upper frequency 596 of about 700 MHz). The dimensions of the resonant element, the dielectric media used to couple the energy feed structure to the resonant element, and the separation distance between the resonant element and the ground plane each affect the bandwidth and gain to some degree. To cover larger bandwidths, arrays of the apparatus and system may be constructed, with each array element designed for a different center frequency.

One of ordinary skill in the art will understand that the apparatus, antennas, and systems of various embodiments of the invention can be used in applications other than those involving television reception, and thus, the invention is not to be so limited. The illustrations of an apparatus 100 and a system 110 are intended to provide a general understanding of the structure of various embodiments of the invention, and are not intended to serve as a complete description of all the elements and features of apparatus and systems which might make use of the structures described herein.

Applications which may include the novel apparatus, antennas, and systems of various embodiments of the invention include elements of high-speed computers, communications and signal processing circuitry, processor modules, embedded processors, and application-specific modules, including multilayer, multi-chip modules. Such apparatus, antennas, and systems may further be included as subcomponents within a variety of electronic systems, such as stereo receivers, video cameras, cellular telephones, personal computers, radios, vehicles, and others.

Figure 6:
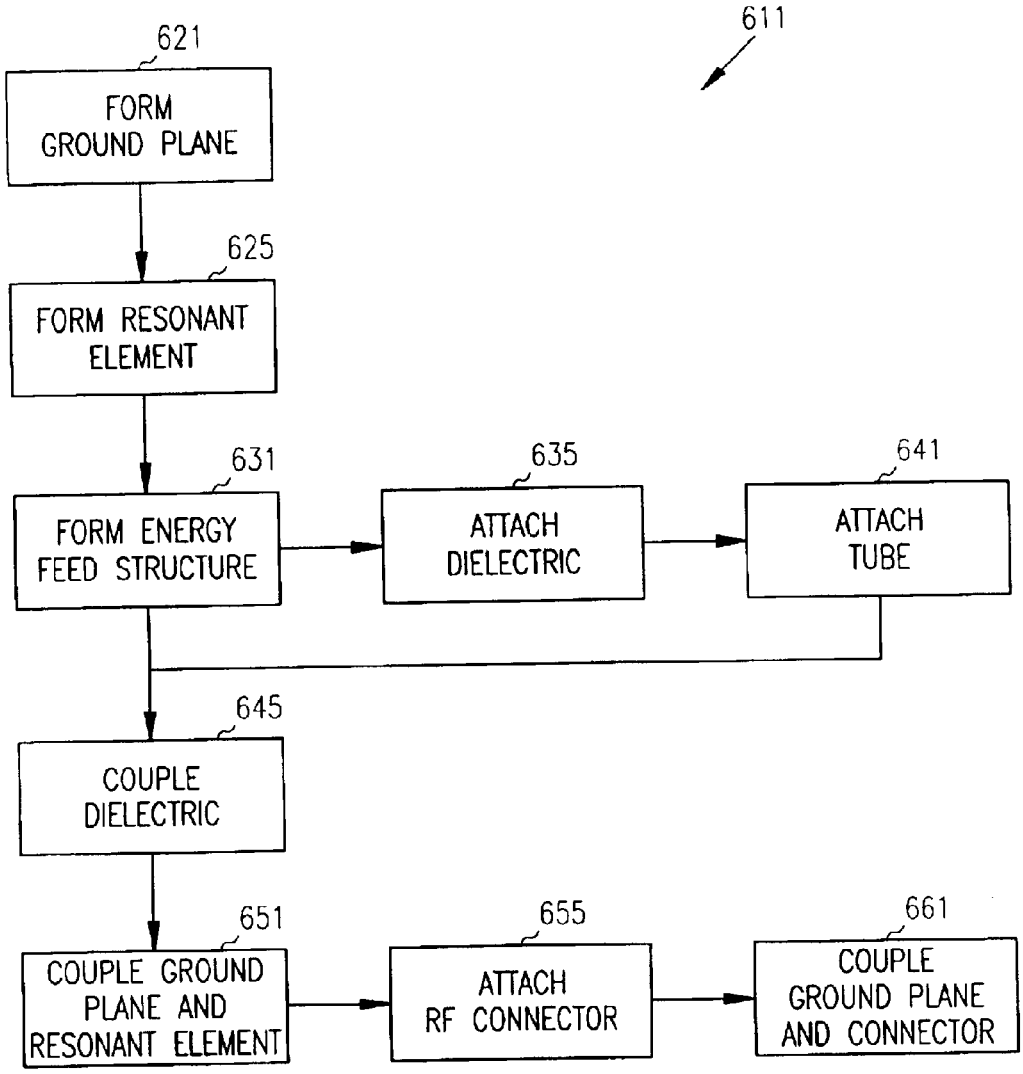
FIG. 6 is a flow chart illustrating a method of fabricating an apparatus and a system according to various embodiments of the invention.

FIG. 6 is a flow chart illustrating a method of fabricating an apparatus and a system according to various embodiments of the invention. The method 611 may include forming a ground plane at block 621, forming a resonant element at block 625, such as a planar resonant element, and forming an energy feed structure at block 631. Forming the feed structure at block 631 may include attaching a solid dielectric element to a first end of a first tube at block 635, and attaching a second tube to a second end (such as the closed end) of the first tube at block 641. The energy feed structure may be formed so as to be capable of passing through the ground plane and being capacitively coupled to the resonant element, so that the method may include capacitively coupling the solid dielectric element to the resonant element by locating the solid dielectric element adjacent the resonant element at block 645.

The method may also include mechanically coupling the ground plane to the planar resonant element at block 651, attaching a radio frequency connector to the energy feed structure at block 655, and mechanically coupling the radio frequency connector to the ground plane at block 661.

The apparatus, systems, and methods of various embodiments of the invention provide a mechanism whereby planar DTV antennas may be constructed for improved reception under multipath signal conditions, especially in distant fringe areas, or receiving locations that do not have a clear path to the transmitting tower. The enhanced method of coupling signal energy to the antenna, using a novel low-Q energy feed structure to couple RF energy to a larger area of the resonant element, improves wideband performance. Constructing the resonant element, and/or the ground plane out of an open mesh operates to reduce the wind effects presented by unshielded, outdoor installations, such as rooftops.

Although specific embodiments have been illustrated and described herein, it should be noted that any arrangement calculated to achieve the same purpose can be substituted for the specific embodiments shown. This disclosure is intended to cover any and all adaptations or variations of embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of embodiments of the invention includes any other applications in which the above structures and methods are used. The scope of embodiments of the invention should be determined with reference to the appended claims, along with the full range of equivalents to which such claims are entitled.

It is emphasized that the Abstract is provided to comply with 37 C.F.R. §1.72(b) requiring an abstract that will allow the reader to quickly ascertain the nature of the technical disclosure. It is submitted with the understanding that it will not be used to interpret or limit the scope or meaning of the claims. In the foregoing Detailed Description of Embodiments of the Invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description of Embodiments of the Invention, with each claim standing on its own as a separate preferred embodiment.

What is claimed is:

1. An energy feed structure, comprising:

a first tube having an open end and a closed end;

a second tube to pierce the closed end of the first tube; and a solid dielectric material to cover the open end of the first tube.

2. The energy feed structure of claim 1, wherein the second tube has a centerline offset a selected and substantially constant distance from a centerline of the first tube.

3. The energy feed structure of claim 1, wherein the closed end comprises a circular metal cap.

4. The energy feed structure of claim 1, wherein the second tube has an outer diameter smaller than an inner diameter of the first tube.

5. The energy feed structure of claim 1, wherein the first tube is electrically coupled to the second tube.

6. The energy feed structure of claim 1, wherein the first tube is capacitively coupled to the second tube.

7. An energy feed structure for an antenna, comprising:

a first tube having a conductive first end including an aperture with a diameter smaller than an inner diameter of the first tube; and a second tube to pass through the aperture, wherein the energy feed structure is to feed energy to the antenna.

8. The energy feed structure of claim 7, further comprising:

a cover to cover a second end of the first tube.

9. The energy feed structure of claim 8, wherein the cover comprises a dielectric material.

10. The energy feed structure of claim 9, wherein the dielectric material comprises a solid dielectric material.

11. The energy feed structure of claim 7, wherein the second tube has an outer diameter smaller than an inner diameter of the first tube.

12. The energy feed structure of claim 7, wherein the second tube has a centerline substantially parallel to a centerline of the first tube.

13. The energy feed structure of claim 7, further comprising:

a radio frequency connector electrically coupled to the second tube.

14. The energy feed structure of claim 13, wherein the radio frequency connector has a center conductor electrically coupled to the second tube.

15. The energy feed structure of claim 7, wherein the conductive first end comprises a cap.

16. The energy feed structure of claim 15, wherein the cap comprises a metal.

17. The energy feed structure of claim 7, wherein the first tube is electrically coupled to the second tube.

18. The energy feed structure of claim 7, wherein the first tube is capacitively coupled to the second tube.

19. A method comprising:

forming an energy feed structure having a first tube comprising a first end and a conductive second end attached to a second tube, wherein forming the energy feed structure further comprises:

attaching a solid dielectric element to the first end.

20. A method comprising:

forming an energy feed structure having a first tube comprising a first end and a conductive second end attached to a second tube, wherein the conductive second end comprises a closed end.

21. A method comprising:

forming an energy feed structure having a first tube comprising a first end and a conductive second end attached to a second tube, and further comprising:

attaching a radio frequency connector to the energy feed structure, wherein a center conductor of the radio frequency connector is electrically coupled to the second tube.

* * * * *